United States Patent [19]

Heaton, III et al.

[11] Patent Number: 4,687,490

[45] Date of Patent: Aug. 18, 1987

[54] PROCESS FOR CONTROLLING THE VISCOSITY AND STABILITY OF A COAL-WATER FUEL SLURRY

[75] Inventors: Harley L. Heaton, III; Joseph H. Lippold, Jr.; Edward T. McHale; Edward G. Skolnik, all of Alexandria, Va.

[73] Assignee: Atlantic Research Corporation, Alexandria, Va.

[21] Appl. No.: 838,122

[22] Filed: Mar. 10, 1986

[51] Int. Cl.[4] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 2,842,319 | 7/1958 | Reerink | 241/29 |
| 4,132,365 | 1/1979 | Verschuur | 241/29 |
| 4,217,109 | 8/1980 | Siwersson | 44/51 |
| 4,248,698 | 2/1981 | Keller, Jr. | 241/16 |
| 4,536,187 | 9/1985 | Hansen et al. | 44/51 |
| 4,552,568 | 11/1985 | Igarashi et al. | 44/51 |

*Primary Examiner*—William R. Dixon, Jr.
*Assistant Examiner*—Margaret B. Medley
*Attorney, Agent, or Firm*—Quaintance, Murphy & Presta

[57] ABSTRACT

According to the present invention there is provided a process for producing a low viscosity, stable coal-water fuel slurry by controlling the concentration of soluble inorganic salts in the coal-water fuel slurry. The process of the present invention comprises determining the soluble ion content of a coal; treating the coal to control the soluble ion content thereof by removing soluble ions from the coal or adding a soluble inorganic salt or electrolyte to the coal; and admixing the coal with a dispersant, a base and water to produce a coal-water fuel slurry comprising 60–75% by weight coal and having a total hardness of 100 ppmc to 1000 ppmc, preferably 200 ppmc to 600 ppmc, expressed as $Ca^{2+}$ ion concentration.

12 Claims, No Drawings

PROCESS FOR CONTROLLING THE VISCOSITY AND STABILITY OF A COAL-WATER FUEL SLURRY

BACKGROUND OF THE INVENTION

A high fuel-value coal-water slurry which can be injected directly into a furnace as a combustible fuel can replace large quantities of fuel oil presently being used by utilities, factories, ships and other commercial enterprises. It is highly desirable that the production time and expense of such coal-water fuel slurries be minimized as much as possible.

For efficient practical use as a fuel, the coal-water slurry must have several essential characteristics. It must have long-term static stability so that it can be stored for extended periods of time by suppliers or at the point of use. During such storage, the slurry must remain uniformly dispersed or, at most, be subject to some soft subsidence which can be easily redispersed by stirring. Uniform dispersion is essential for reliably constant heat output. Coal loadings must be sufficiently high; for example, 60 to 70 percent or higher, to produce adequate fuel value despite the presence of an inert water carrier. The slurry must also be sufficiently fluid; that is, have a sufficiently low viscosity, to be pumped to and sprayed into a combustion chamber.

Generally, the prior art has focused on reducing the viscosity of a coal-water slurry by the use of anionic ammonium, alkali metal, or alkaline earth metal organic dispersants. The anion of such dispersants is a high molecular weight organic moiety which attaches to the coal particles to give them a high negative charge or zeta potential, which in turn causes repulsion sufficient to overcome Van der Waal's attraction, thereby preventing flocculation which leads to an increase in viscosity. U.S. Pat. No. 4,526,584 to Funk, for example, suggests the use of a dispersing agent to promote deflocculation of carbonaceous particles, preferably in the presence of advantageous electrolytes. Funk teaches that the presence of monovalent cations such as $Na^+$, or $Li^+$ or $K^+$ tends to promote deflocculation, and further advises against the use of multivalent cations such as $Ca^{2+}$, $Al^{3+}$ and $Mg^{2+}$ which tend to cause the carbonaceous particles to flocculate under certain conditions. Funk also teaches that it is preferred to incorporate an advantageous monovalent electrolyte, such as an ammonium or alkali metal base, into an aqueous slurry to increase deflocculation of the slurry. U.S. Pat. No. 4,504,277 to Scheffee suggests the use of a combination of an ammonium salt organic dispersant and an alkaline earth metal salt organic dispersant for improving the viscosity and storage stability of a coal-water fuel slurry. None of the references teaches or suggests the unique capability of soluble inorganic alkaline earth metal salts to control the stability and viscosity of a coal-water fuel slurry. None of the references teaches or suggests controlling the concentration of polyvalent cations in a coal-water fuel slurry in order to control the viscosity and stability of the slurry.

OBJECTS OF THE INVENTION

It is therefore an object of the invention to provide a process for producing coal-water fuel slurries having improved stability and viscosity characteristics.

It is another object of the present invention to provide a process for controlling the viscosity and stability of coal-water fuel slurries by controlling the polyvalent cation concentration of such slurries.

It is still another object of the present invention to provide a process for producing coal-water fuel slurries which does not require the use of high concentrations of dispersant to produce a sufficiently low viscosity coal-water fuel.

It is still another object of the present invention to provide a process for producing a coal-water fuel slurry which does not require the use of a costly stabilizer to poduce a sufficiently stable coal-water fuel slurry.

A still further object of the present invention is to provide a process for producing a coal-water fuel slurry which includes use of a stabilizer that does not biodegrade so that a biocide is unnecessary.

Other objects of the present invention will be apparent to those skilled in the art by reference to the following description and examples.

SUMMARY OF THE INVENTION

According to the present invention there is provided a process for producing a low viscosity, stable coal-water fel slurry by controlling the concentration of soluble inorganic salts in the coal-water fuel slurry. In its broadest aspects, the process of the present invention comprises the steps of: determining the soluble ion content of a coal; treating the coal to control the soluble ion content thereof by either removing soluble ions from the finely divided coal or adding a soluble inorganic salt or electrolyte to the coal; and admixing the coal with a dispersant, a base and water to produce a coal-water fuel slurry comprising approximately 60–75% by weight coal, the coal-water fuel slurry exhibiting a total hardness of approximately 100 ppmc to 1000 ppmc, preferably 200 ppmc to 600 ppmc, expressed as $Ca^{2+}$ ion concentration as measured by a specified procedure, where ppmc represents parts per million of coal.

DETAILED DESCRIPTION OF THE INVENTION

The present invention relates to a process for producing a stable, low-viscosity coal-water fuel slurry by controlling the concentration of soluble inorganic salts in the coal-water fuel slurry. According to the process of this invention, the stability and viscosity of a coal-water fuel slurry are controlled by controlling the concentration of soluble inorganic salts in the coal-water fuel slurry. Coal-water fuel slurries produced by the process of this invention will have a total hardness of from 100 ppmc to 1000 ppmc, where ppmc represents parts per million of coal. The total hardness of the coal-water fuel slurries is preferably from 200 ppmc to 600 ppmc. "Total hardness" as used herein means the total concentration of $Mg^{2+}$ ions and $Ca^{2+}$ ions plus trivalent ions, expressed as ppmc $Ca^{2+}$. The total hardness is determined by measuring the concentration of $Mg^{2+}$, $Ca^{2+}$ and trivalent ions, converting the concentration of $Mg^{2+}$ and trivalent ions into equivalent concentrations of $Ca^{2+}$ by correcting for the atomic mass differences, and summing all the ion concentrations to express the total as $Ca^{2+}$. Polyvalent ions such as $Fe^{3+}$ and $Al^{3+}$ also affect the stability and viscosity of a coal-water fuel slurry if the pH is low enough to prevent precipitation of the hydroxides. Thus, for example, if the concentration of $Fe^{3+}$ ions is 20 ppmc or more, the total hardness of the coal-water fuel slurry expressed as ppmc $Ca^{2+}$ is preferably within a range of about 100 ppmc to 300 ppmc, inasmuch as trivalent ions are more effective than divalent ions.

In the process of the present invention, raw coal is ground or crushed to produce a ground coal having a particle size of less than ¼" and preferably having a particle size of about 10 mesh X 0. The raw coal can be crushed or ground using any known method capable of sufficiently reducing the particle size of the raw coal. Examples of such grinding methods include cage milling, hammer milling, ball milling, rod milling, roller milling, bowl milling, roll and race milling, etc.

A measure of the soluble ion content of the ground coal is then obtained. One method for determining the soluble ion content is as follows. A sample of the ground coal, for example 250 grams, is mixed with an equal amount by weight of water to produce a coal and water mixture. The coal and water mixture is then agitated for approximately two (2) hours. One suitable procedure for agitating the coal and water mixture comprises placing the coal and water in a one quart jar and shaking the jar on a mechanical shaker for the specified length of time. After this agitation step has been completed, the coal and water mixture is allowed to sit undisturbed for about sixteen (16) hours. The coal and water mixture is then filtered and standard ion tests are performed on the liquid filtrate. The standard ion tests measure or determine total hardness in the filtrate expressed as $Ca^{2+}$. Total hardness is the sum of $Ca^{2+}$ plus $Mg^{2+}$ and iron ions corrected for the atomic mass differences, thus allowing expression as $Ca^{2+}$. Trivalent ion concentrations in coal other than iron are negligible for purposes of this process. These tests are conducted as follows:

Hardness Test for Calcium and Magnesium

Use a Hach Total Hardness Test Kit Model HA-DT equipped with a digital titrator.

1. Place 100 ml of filtrate in a flask.
2. Add 1 ml Buffer Solution; stir.
3. Add 1 Manver II Hardness Indicator Powder Pillow. Sample should turn red.
4. Titrate with an EDTA cartridge using a 0.8 M cartridge for a high hardness sample and a 0.08 M cartridge for a sample with a low hardness concentration. Titrate until a color change from red to blue occurs.
5. Read number off of digital titrator. The 0.08 M cartridge reads directly in mg/liter, while for the 0.08 cartridge, divide the number by 10 to get mg/liter.
6. This is the hardness concentration expressed as $CaCO_3$. To get hardness expressed as $Ca^{2+}$, multiply by 0.4.

Total Iron Test

1. Use 25 ml filtrate. Adjust pH to between 4 and 5 using 1N HCl solution. Add one Hach "Ferro-Ver" Iron Reagent Powder Pillow (1,10 Phenanthroline) and stir.
2. Wait about 10 minutes (but no more than 30 minutes) for color (orange) to develop.
3. Using a Hach DR3 Spectrophotometer:
   a. Adjust the wave length to 510 nm.
   b. Insert Ferro-Ver Iron Test Card into Spectrophotometer
   c. Using a blank couvette adjust "right" and "left end" controls. This zeros the instrument and gives a 100% transmittance full scale readout.
   d. Insert couvette with sample.
   e. Read total iron directly off card in mg/liter.

If the results of the standard ion tests indicate that the soluble ion content of the ground coal is too low, then this ion content is increased to the proper concentration range, usually after the coal-water slurry has been produced, as described later in this Description.

If the results of the standard ion tests indicate that the soluble ion content of the ground coal is large, the ground coal is subjected to a washing process to remove soluble inorganic salts therefrom. The ground coal can be washed in any manner capable of leaching out or removing soluble inorganic salts from the ground coal. The ground coal can be washed with water in a mixing vat or sprayed with water as the ground coal passes along on a moving belt or conveyor. Alternatively, soluble inorganic salts can be removed from the ground coal in a beneficiation step such as froth flotation. The soluble ion content is measured again after washing. After being washed or sprayed with water, the ground coal is dewatered using a known filter such as a vacuum rotary drum or disc filter. The dewatering can be carried further by, for example, thermal drying if further coal comminution by a dry milling process is to be used prior to preparation of the final slurry product.

The ground coal which has been washed, or which did not require washing based on its soluble ion content, is admixed with water, a dispersant and a base to produce a coal-water slurry comprising approximately 60–75% by weight coal based on the weight of the slurry. One preferred method of admixing the ground coal with water, a dispersant and a base and thereby producing a coal-water slurry comprises wet ball-milling. The ground coal, water, dispersant and base are wet ball-milled together to produce a coal-water slurry comprising approximately 60–75% by weight coal based on the weight of the slurry, wherein the coal in the coal-water slurry typically has a particle size of 80% less than 200 mesh after ball milling, although this value can range widely from 60% to 100%.

In the process of this invention it is convenient to produce the final slurry product by ball-milling under wet conditions, which can be done in either a batch or continuous mode. Conditions of the milling operation, such as the number and size of balls, the size and rotational speed of the mill, the length of milling time, the geometry of the mill interior and of the entrance and discharge ports, are familiar to those versed in the art. The coal, water and additive contents may be set in advance of the milling operation to provide a product slurry of exactly the desired concentration, or alternatively the coal content may be intentionally set at a low level (such as 40% or 50%) during milling and increased to the desired level afterwards by a dewatering process. The ball-milling processes described here are presented by way of example and are not intended to be limiting inasmuch as there are numerous methods of milling coal into a final product slurry, including dry methods using a ball mill, or any of a number of other mills such as those cited earlier. If any dry milling method is employed, then for a case in which the soluble ion content of the coal is too large, the washing step to reduce this ion level may preferably be conducted after the dry milling to avoid a dewatering and drying procedure prior to the milling.

In the process of the present invention, ground coal is admixed, preferably by wet ball-milling, with water, a dispersant and a base to produce a coal-water slurry. The presence of the dispersant allows a high degree of loading in the final coal-water fuel slurry without reducing the efficient combustion of the coal-water fuel slurry. In addition, the dispersant charges the surface of the solid particles of coal and thereby reduces the viscosity of the final coal-water fuel slurry and improves the dispersion of the coal particles in water. The base with which the ground coal is admixed in the present invention controls the pH of the final coal-water fuel slurry. In the dispersion process the hydrophobic moiety of an anionic dispersant adsorbs onto a coal particle surface leaving the anionic end exposed in the water medium. The corresponding cation (or counter ion) is present in the water phase. The result is a negative charge being applied to the surface of all coal particles, which leads to electronic particle-particle repulsion and thereby dispersion.

Dispersants useful in the process of the present invention include but are not limited to: salts of maleic anhydride and salts of maleic acid or derivatized maleic acid such as pentane substituted derivatives of maleic acid, naphthalene sulfonates such as sodium naphthalene sulfonate, ammonium naphthalene sulfonate and calcium naphthalene sulfonate, the formaldehyde condensation derivatives of these, and lignosulfonates such as sodium lignosulfonate, ammonium lignosulfonate and calcium lignosulfonate, and lignocarboxylates such as sodium lignocarboxylate, ammonium lignocarboxylate and calcium lignocarboxylate. The preferred dispersant in the process of the present invention is a member selected from the group consisting of ammonium lignosulfonate, sodium lignosulfonate, ammonium napthalene sulfonate and sodium naphthalene sulfonate. The most preferred dispersants are ammonium salts of condensed naphthalene sulfonates and ammonium lignosulfonates.

The weight ratio of dispersant to coal in the present invention is from 0.01:100 to 7.0:100. Preferably, the weight ratio of dispersant to coal is from 0.05:100 to 2.0:100.

Any base which will control the pH of the coal-water fuel slurry without adversely affecting the slurry can be used in the process of the present invention. Among the bases useful in this invention are: ammonium hydroxide, calcium hydroxide, sodium hydroxide, potassium hydroxide, diethylamine and triethanolamine. Preferably, the base is a member selected from the group consisting of ammonium hydroxide, sodium hydroxide and potassium hydroxide. The most preferred base is ammonium hydroxide.

In the present invention, the weight ratio of base to coal is from 0.01:100 to 2.5:100. Preferably, the weight ratio of base to coal in the present invention is from 0.05:100 to 1.0:100.

After the coal-water slurry has been produced, the total hardness of the coal-water slurry expressed as ppmc $Ca^{2+}$ can be adjusted as necessary to produce a stable, low-viscosity coal-water fuel slurry having a total hardness of 100 ppmc to 1000 ppmc, preferably from 200 ppmc to 600 ppmc. The stability and viscosity of the coal-water fuel slurry of the present invention is controlled by controlling the soluble inorganic salt content of the coal-water fuel slurry. If the soluble ion content of the coal in the coal-water slurry had been previously adjusted by washing the ground coal, further adjustment of the total hardness may not be necessary to produce a coal-water fuel slurry having a total hardness of 200 to 600 ppmc expressed as ppmc $Ca^{2+}$. However, if the soluble ion content of the ground coal was reduced too much during a washing step, or if the soluble ion content was too low to begin with, it may be necessary to again adjust the soluble inorganic salt concentration and total hardness of the coal-water slurry produced therefrom.

If the soluble ion concentration of the coal-water slurry is too low, then according to the process of this invention the soluble ion concentration must be adjusted to produce a coal-water fuel slurry having a total hardness of 100 ppmc to 1000 ppmc, and preferably 200 ppmc to 600 ppmc. Typically, the soluble ion concentration of a coal-water slurry will be too low if the raw coal from which the coal-water slurry was produced had a low soluble ion content. Further, the soluble ion concentration of a coal-water slurry could be too low if the raw coal was subjected to an overly extensive or lengthy washing process at the mine site. If the soluble ion concentration of a coal-water fuel slurry is too low, the coal-water fuel slurry will be unstable. If the soluble ion concentration of the coal-water fuel slurry is too high, however, the coal-water fuel slurry will be too viscous, and at very high ion concentrations, unpourable. Thus, it is important that in adjusting the soluble ion concentration of the coal-water slurry care is taken not to increase the soluble ion concentration too much. The soluble ion concentration of the coal-water slurry should be held to within a range of 100 ppmc to 1000 ppmc total hardness, and preferably to between 200 ppmc and 600 ppmc total hardness expressed as ppmc $Ca^{1+}$.

If the soluble ion concentration of the coal-water slurry is too low, that is, below about 100 ppmc total hardness, then the soluble inorganic salt content of the coal-water slurry must be raised. To raise the soluble ion concentration of the coal-water slurry, a soluble trivalent or preferably a soluble divalent inorganic salt is added to the coal-water slurry. Preferably the divalent inorganic salt is a member selected from the group consisting of salts of $Ca^{2+}$, $Mg^{2+}$ and $Fe^{2+}$. The trivalent salt is preferably selected from the group of $Al^{+3}$ and $Fe^{+3}$ salts. The salt is added to the coal-water slurry in an amount sufficient to produce a coal-water fuel slurry having a total hardness of 100 ppmc to 1000 ppmc, and preferably 200 ppmc to 600 ppmc, expressed as ppmc $Ca^{2+}$ in the slurry. The salt can be added to the coal-water slurry during the wet ball-milling or during a mixing step following milling. A preferred method would include high-shear mixing of the coal-water slurry and added salt following the milling to produce a coal-water fuel slurry.

EXAMPLES

Examples I–V illustrate the process of the present invention wherein the stability and viscosity of a coal-water fuel slurry are controlled by the addition of a soluble inorganic calcium salt to the coal-water fuel slurry. Examples VI and VII illustrate the present invention wherein the viscosity and stability of a coal-water fuel slurry are controlled by removing soluble inorganic salts from a coal by froth flotation. Examples VIII–XII illustrate the process of the present invention wherein the stability and viscosity of a coal-water fuel slurry are controlled by washing the coal with water. Examples XIII–XIX illustrate the process of the present invention wherein the stability and viscosity of a coal-water fuel slurry are controlled by addition of trivalent cations.

EXAMPLE I

FPL Black coal, a coal which had been previously washed and determined to have a total hardness of 32 ppmc expressed as ppmc $Ca^{2+}$, was admixed with 0.4 parts per hundred parts coal by weight (pphc) of a naphthalene sulfonate, 0.1 pphc $NH_4OH$ and water to produce a coal-water slurry comprising 70% by weight coal based on the weight of the slurry. The viscosity of this coal-water fuel slurry made with FPL Black coal was 310 cps as measured by a Haake rotational viscometer. The coal-water fuel slurry was unstable and produced a one-inch hard-pack sediment on setting overnight.

EXAMPLE II

The soluble inorganic salt $CaCl_2$ was added to the coal-water fuel slurry of Example I in an amount sufficient to produce a coal-water fuel slurry having a total hardness of 210 ppmc expressed as ppmc $Ca^{2+}$. The addition of the $CaCl_2$ imparted a large amount of stability to the coal-water fuel slurry with only a slight increase in viscosity. This coal-water fuel slurry exhibited only a trace of sediment on setting overnight. The viscosity of this coal-water fuel slurry was 370 cps.

EXAMPLE III

The soluble inorganic salt $CaCl_2$ was added to the coal-water fuel slurry produced in Example II in an amount sufficient to produce a coal-water fuel slurry having a total hardness of 330 ppmc expressed as ppmc $Ca^{2+}$. This coal-water fuel slurry was completely stable and had a viscosity of 750 cps.

EXAMPLE IV $CaCl_2$ was added to the coal-water fuel slurry produced in Example III in an amount sufficient to produce a coal-water fuel slurry having a total hardness of 490 ppmc expressed as ppmc $Ca^{2+}$. This coal-water fuel slurry was much thicker with a viscosity of 2030 cps and was completely stable.

EXAMPLE V

Sufficient $CaCl_2$ was added to the coal-water fuel slurry produced in Example IV to produce a coal-water fuel slurry having a total hardness of 630 ppmc expressed as ppmc $Ca^{2+}$. This coal-water fuel slurry had a high viscosity and was unpourable, but nevertheless exhibited no settling.

EXAMPLE VI

Hazard coal was tested and found to have a total hardness of 831 ppmc expressed as ppmc $Ca^{2+}$. A coal-water fuel slurry with this Hazard coal was made as follows: The Hazard coal was admixed with 1.0 pphc of a naphthalene sulfonate, 0.2 pphc $NH_4OH$ and water in an amount sufficient to produce a coal-water fuel slurry comprising 68% by weight coal based on the weight of the slurry. This mixture was milled in an eight (8) inch ball mill for 100 minutes and resulted in a coal-water fuel slurry which had particles 82% less than 200 mesh, had a viscosity of 1856 cps as measured by a Haake rotational viscometer, and was completely stable.

EXAMPLE VII

The Hazard coal of Example VI was subjected to froth flotation, thereby allowing removal of soluble inorganic salts by leaching, prior to being admixed with water, dispersant and base to produce a coal-water fuel slurry. A coal-water fuel slurry was then made using the Hazard coal which had been subjected to froth flotation. The coal-water fuel slurry was made in the same manner, using the same amounts of water, dispersant and base, as set forth in Example VI. The coal-water fuel slurry produced thereby had particles 85% less than 200 mesh with a Haake viscosity of 993 cps, and also was stable.

EXAMPLE VIII

A coal-water fuel slurry was produced from a coal reclaimed from a tailings pond. The coal contained 600 ppmc total hardness expressed as $Ca^{2+}$ and 7 ppmc total iron. It required 0.8 pphc of a naphthalene sulfonate dispersant to make an acceptable coal-water fuel slurry comprising 70% by weight coal based on the weight of the slurry. This coal-water fuel slurry had a viscosity of 1305 cps and was stable.

EXAMPLE IX

In this example, the same coal recovered from a tailings pond was washed with water and then dewatered prior to producing a coal-water fuel slurry therefrom. The washed coal contained only 80 ppmc total hardness expressed as ppmc $Ca^{2+}$ and 2 ppmc total iron. A coal-water fuel slurry made from this washed coal was then made with only 0.6 pphc of the same dispersant as in Example VIII. This coal-water fuel slurry had a viscosity of 591 cps, but was not stable.

EXAMPLE X

Kopperston coal, a coal which had been previously washed and determined to have a total hardness of 34 ppmc expressed as $Ca^{2+}$, was admixed with 0.6 pphc of a napthalene sulfonate, 0.2 pphc $NH_4OH$ and water to produce a coal-water slurry comprising 70% by weight coal based on the weight of the slurry. The viscosity of this coal-water fuel slurry made with Kopperston coal was 743 cps. The slurry was unstable and produced a one-half inch hard-pack sediment in a jar on setting overnight.

EXAMPLE XI

The soluble inorganic salt $MgCl_2$ was added to the coal-water fuel slurry of Example X in an amount sufficient to produce a coal-water fuel slurry having a total concentration of divalent cations equal to 330 ppmc expressed as $Ca^{2+}$. The addition of the $MgCl_2$ imparted a large amount of stability to the coal-water fuel slurry. This slurry had a viscosity of 1154 cps and showed no settling on setting overnight.

EXAMPLE XII

The soluble inorganic salt ferrous sulfate, $FeSO_4$, was added to the coal-water fuel slurry of Example X in an amount sufficient to produce a coal-water fuel slurry having a total concentration of divalent cations equal to 330 ppmc expressed as $Ca^{2+}$. The addition of the $FeSO_4$ imparted a large amount of stability to the coal-water fuel slurry. This slurry showed no settling on setting overnight and had a viscosity of 1113 cps.

EXAMPLE XIII

The soluble inorganic salt ferric acetate (basic) ($FeOH(CH_3COO)_2$) was added to the coal-water fuel slurry of Example X in an amount sufficient to produce a coal-water fuel slurry having a total calculated concentration when totally ionized to trivalent ferric ions of 30 ppmc, also expressed as $Ca^{2+}$. The viscosity of this coal-water fuel slurry was 797 cps. The slurry was similar to the slurry in Example X in that it was unstable, forming one-half inch hard-pack sediment on setting overnight. The pH of this slurry was 8.85, at which level of basicity there would be essentially zero trivalent ferric ions.

EXAMPLE XIV

The pH of the coal-water fuel slurry in Example XIII was reduced to 6.45 by using HCl. The slurry exhibited a viscosity of 1610 cps and was stable on setting overnight.

EXAMPLE XV

The pH of the coal-water fuel slurry in Example XIII was reduced to 4.05 by using HCl. The slurry was barely pourable, having a viscosity of 2977 cps, and being of marginal practical use.

EXAMPLE XVI

The pH of the coal-water fuel slurry in Example XIII was reduced to 2.90 by using HCl. The slurry was nonpourable and of no practical use.

EXAMPLE XVII

The soluble inorganic salt $Al(NO_3)_3$ was added to the coal-water fuel slurry of Example X in an amount sufficient to produce a coal-water fuel slurry having a total concentration of trivalent aluminum ions of 30 ppmc expressed as $Ca^{2+}$. The pH of the slurry was adjusted to 6.70 by using HCl. The slurry exhibited a viscosity of 1482 cps and was stable on setting overnight.

EXAMPLE XVIII

The pH of the coal-water fuel slurry in Example XVII was reduced to 4.25 by using HCl. The fuel had thickened to a viscosity level of 1961 cps and was stable on setting overnight.

EXAMPLE XIX

The pH of the coal-water fuel slurry in Example XVII was lowered to 2.00 by using HCl. The slurry was nonpourable and of no practical use.

As can be seen from the above examples, the viscosity and stability of coal-water fuel slurries can be controlled by controlling the concentration of soluble inorganic salts in accordance with the present invention. Examples I–V and X–XII clearly illustrate the process of the present invention wherein the stability and viscosity of a coal-water fuel slurry are controlled by adding an inorganic soluble salt to a coal-water fuel slurry in an amount sufficient to produce a coal-water fuel slurry having a total divalent ion concentration of from 200 ppmc to 600 ppmc expressed as ppmc $Ca^{2+}$ relative to the coal. Examples VI and VII illustrate the process of the present invention wherein the viscosity and stability of a coal-water fuel slurry are controlled by removing sufficient soluble inorganic salts by froth flotation to produce a coal-water fuel slurry having improved properties. Examples VIII and IX further illustrate the control of the viscosity of a coal-water fuel slurry by removing soluble inorganic salts from the coal prior to making the coal-water fuel slurry. In addition, Examples VIII and IX illustrate that the process of the present invention permits the production of coal-water fuel slurries having improved viscosity at reduced concentrations of dispersants.

Examples XIII–XIX illustrate the process of the present invention wherein the viscosity and stability of the coal-water fuel slurry are controlled by adding a trivalent inorganic soluble salt in sufficient concentration to produce a coal-water fuel slurry having a total trivalent ion concentration of 30 ppmc expressed as $Ca^{2+}$, and controlling the pH.

Although the invention has described in detail with reference to specific embodiments thereof, it will be understood that variations can be made without departing from the scope of the invention as described above and as claimed below.

What is claimed is:

1. Process for producing a stable coal-water fuel slurry which comprises the steps of:
   - I. determining the soluble ion content of a coal;
   - II. treating the coal to control the soluble ion content by removing soluble ions from the coal or adding an inorganic polyelectrolyte to the coal; and
   - III. admixing the coal with a dispersant, a base and water to produce a coal-water fuel slurry comprising approximately 60–75% by weight coal and having a total hardness of 100 ppmc to 1000 ppmc expressed as $Ca^{2+}$ ion concentration.

2. Process for producing a coal-water fuel slurry which comprises the steps of:
   - I. grinding a sample of a raw coal to produce a finely divided coal;
   - II. determining the soluble ion content of the finely divided coal;
   - III. admixing the raw coal with a dispersant, a base and water to produce a coal-water slurry which comprises approximately 60–75% by weight coal; and
   - IV. adjusting the soluble ion concentration of the coal-water slurry by removing soluble ions from the coal or adding an inorganic polyelectrolyte to the coal to produce a coal-water fuel slurry having a total hardness of 100 ppmc to 1000 ppmc expressed as $Ca_{2+}$ ion.

3. Process for producing a coal-water fuel slurry which comprises the steps of:
   - I. grinding a sample of a raw coal to produce a finely divided coal;
   - II. measuring the soluble ion content of the finely divided coal by mixing a sample of the finely divided coal with an equal amount by weight of water to produce a coal and water mixture, agitating the coal and water mixture for two (2) hours, permitting the coal and water mixture to sit undisturbed for sixteen (16) hours, filtering the coal and water mixture and measuring the soluble ion content of the liquid filtrate obtained from the filtering of the coal and water mixture;
   - III. admixing the raw coal with a dispersant, a base and water to produce a coal-water slurry which comprises 60–75% by weight coal; and
   - IV. adjusting the polyvalent ion concentration of the coal-water slurry by removing soluble ions from the coal or adding an inorganic polyelectrolyte to the coal, said polyvalent ion concentration being determinable from the polyvalent ion content measured in Step II, to produce a coal-water fuel slurry having a total hardness of 100 ppmc to 1000 ppmc expressed as ppmc $Ca^{2+}$ ion.

4. The process of claim 4 wherein the adjusting of the polyvalent ion concentration of the coal-water slurry of Step IV comprises adding a soluble inorganic salt selected from the group consisting of $Ca^{2+}$, $Mg^{2+}$ and $Fe^{2+}$ compounds to the coal-water slurry in an amount sufficient to produce a coal-water fuel slurry having a total hardness of 100 ppmc to 1000 ppmc expressed as $Ca^{2+}$ ion.

5. The process of claim 3 wherein the steps are performed :n the following order: I, II, IV, III.

6. The process of claim 5 wherein the adjusting of the polyvalent ion concentration of Step IV comprises washing the raw coal with water to remove an amount of soluble ions sufficient to produce a coal-water fuel slurry having a total hardness of 100 ppmc to 1000 ppmc expressed as ppmc $Ca^{2+}$ ion.

7. The process of claim 5 wherein adjusting of the polyvalent ion concentration comprises subjecting the raw coal to froth flotation to remove an amount of soluble ion sufficient to produce a coal-water fuel slurry having a total hardness of 100 ppmc to 1000 ppmc expressed as ppmc $Ca^{2+}$ ion.

8. Process for producing a coal-water fuel slurry which comprises the steps of:

I. grinding raw coal to produce a finely divided coal having a particle size of 10 mesh X 0;

II. measuring the soluble ion content of the finely divided coal by mixing a sample of the finely divided coal with an equal amount by weight of water to produce a coal and water mixture, agitating the coal and water mixture for two (2) hours, permitting the coal and water mixture to sit undisturbed for sixteen (16) hours, filtering the coal and water mixture and measuring the soluble ion content of the liquid filtrate obtained from the filtering of the coal and water mixture;

III. admixing the finely divided coal produced in Step I with a dispersant, a base, water and a divalent electrolyte selected from the group consisting of $Ca(OH)_2$, $CaCl_2$ and CaO to produce a coal-water fuel slurry;

wherein the divalent electrolyte is added in an amount sufficient to raise the total hardness of the coal-water fuel slurry to between 200 ppmc and 600 ppmc expressed as ppmc $Ca^{2+}$ ion; and wherein the coal-water fuel slurry comprises 60–75% by weight coal.

9. Process for producing a coal-water fuel slurry which comprises the steps of:

I. grinding raw coal to produce a finely divided coal having a particle size of 10 mesh X 0;

II. measuring the soluble ion content of the finely divided coal by mixing a sample of the finely divided coal with an equal amount by weight of water to produce a coal and water mixture, agitating the coal and water mixture for two (2) hours, permitting the coal and water mixture to sit undisturbed for sixteen (16) hours, filtering the coal and water mixture and measuring the soluble ion content of the liquid filtrate obtained from the filtering of the coal and water mixture;

III. washing the finely divided coal produced in Step I with water to remove soluble inorganic salts;

IV. dewatering the washed coal;

V. admixing the washed coal with a dispersant, a base and water to produce a coal-water fuel slurry which comprises 60–75% by weight coal and which has a total hardness of 200 ppmc to 600 ppmc expressed as ppmc $Ca^{2+}$ ion concentration.

10. Process for producing a coal-water fuel slurry which comprises the steps of:

I. grinding raw coal to produce a finely divided coal having a particle size of 10 mesh X 0;

II. measuring the soluble ion content of the finely divided coal by mixing a sample of the finely divided coal with an equal amount by weight of water to produce a coal and water mixture, agitating the coal and water mixture for two (2) hours, permitting the coal and water mixture to sit undisturbed for sixteen (16) hours, filtering the coal and water mixture and measuring the soluble ion content of the liquid filtrate obtained from the filtering of the coal and water mixture;

III. subjecting the finely, divided coal produced in Step I to froth flotation to remove soluble inorganic salts and to produce a washed coal;

IV. admixing the washed coal with a dispersant, a base and water to produce a coal-water fuel slurry which comprises 60–75% by weight coal and has a total hardness of 200 ppmc to 600 ppmc expressed as ppmc $Ca^{2+}$ ion concentration.

11. Process for controlling the stability and viscosity of a coal-water fuel slurry which comprises controlling the concentration of soluble inorganic salts in the coal-water fuel slurry by removing soluble ions from the coal or adding an inorganic polyelectrolyte to the coal such that the total hardness of the coal-water fuel slurry is from 100 ppmc to 1000 ppmc expressed as ppmc $Ca^{2+}$ ion in the slurry.

12. Process for producing a stable, low-viscosity coal-water fuel slurry by controlling the concentration of soluble inorganic salts in the coal-water fuel slurry by removing soluble ions from the coal or adding an inorganic polyelectrolyte to the coal such that the total hardness of the coal-water fuel slurry is from 100 ppmc to 1000 ppmc expressed as ppmc $Ca^{2+}$ ion; wherein said coal-water fuel slurry comprises finely divided coal having a particle size of at least 60% less than 200 mesh, water, a dispersant and a base, and wherein said coal-water fuel slurry comprises 60–75% by weight coal based on the weight of the slurry.

* * * * *